US007954634B2

(12) United States Patent
Blakeman

(10) Patent No.: US 7,954,634 B2
(45) Date of Patent: Jun. 7, 2011

(54) SPECIFIC THEME-SHAPED ECO-FRIENDLY DISPOSABLE WET WIPE CONTAINER, AND METHODS OF CONSTRUCTING AND UTILIZING SAME

(76) Inventor: Amanda Blakeman, Las Vegas, NV (US)

( * ) Notice: Subject to any disclaimer, the term of this patent is extended or adjusted under 35 U.S.C. 154(b) by 0 days.

(21) Appl. No.: 12/573,223

(22) Filed: Oct. 5, 2009

(65) Prior Publication Data

US 2011/0079526 A1 Apr. 7, 2011

(51) Int. Cl.
*B65D 69/00* (2006.01)

(52) U.S. Cl. ..... 206/233; 206/457; 206/494; 220/345.1; 220/345.3

(58) Field of Classification Search ..... 206/457, 206/233, 494, 822; 221/33, 45; 426/87; 219/727; D9/668; 220/345.1–345.3, DIG. 13
See application file for complete search history.

(56) References Cited

U.S. PATENT DOCUMENTS

| | | | | |
|---|---|---|---|---|
| D323,948 | S * | 2/1992 | Cooper | D6/518 |
| 6,410,065 | B1 * | 6/2002 | Nottingham et al. | 426/87 |
| D575,079 | S * | 8/2008 | Hirsh | D6/434 |
| D575,965 | S * | 9/2008 | Weldon | D6/434 |
| 2006/0054517 | A1 * | 3/2006 | Albert | 206/233 |
| 2007/0012715 | A1 * | 1/2007 | Dubreuil et al. | 221/33 |
| 2008/0115671 | A1 * | 5/2008 | Sauer et al. | 96/223 |

FOREIGN PATENT DOCUMENTS

JP 02003040300 A * 7/2001

* cited by examiner

*Primary Examiner* — J. Gregory Pickett
*Assistant Examiner* — Raven Collins
(74) *Attorney, Agent, or Firm* — Weiner & Burt, P.C.; Irving M. Weiner; Pamela S. Burt

(57) ABSTRACT

A specific theme-shaped eco-friendly disposable wet wipe container having a main theme-shaped disposable eco-friendly housing structure for holding wet wipes and having a base. A selectively openable and closable lid member is movably connected to the housing structure so that the lid member must move in a flat plane parallel to the base. An area is provided for placement of a logo or emblem.

20 Claims, 2 Drawing Sheets

SPECIFIC THEME-SHAPED ECO-FRIENDLY DISPOSABLE WET WIPE CONTAINER, AND METHODS OF CONSTRUCTING AND UTILIZING SAME

CROSS-REFERENCE TO RELATED APPLICATIONS

Not applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

The term "theme-shaped" as used herein means any one of various customized shapes, including, but not limited to, a football, a soccer ball, a baseball, a golf ball, a race car driver's helmet, stacked tires, a football helmet, a basketball, a baseball cap, a car, a puppy, a cat, an elephant, a bumblebee, a strawberry, a cake, a hockey puck, a round disc shape, a cone shape, and a teddy bear.

The phrase "a renewable resource" as used herein means any renewable resource, including, but not limited to, bamboo pulp, corn sugar or a fibrous residue remaining after sugarcane or sorghum stalks are crushed to extract their juice.

The present invention relates to a novel and unique specific theme-shaped eco-friendly disposable wet wipe container, and methods of constructing and utilizing same.

More particularly, the present invention relates to a novel and unique specific theme-shaped eco-friendly disposable wet wipe container fabricated from a renewable resource, and methods of constructing and utilizing same.

It is a desideratum of the present invention to avoid the animadversions of conventional wet wipe containers, and at the same time to provide a very convenient and unique specific theme-shaped eco-friendly disposable wet wipe container.

SUMMARY OF THE INVENTION

The present invention provides a specific theme-shaped eco-friendly disposable wet wipe container, comprising: a main theme-shaped disposable eco-friendly housing structure for holding therein a plurality of wet wipes; said main theme-shaped disposable eco-friendly housing structure is provided with a base; a selectively openable and closable lid member for said main theme-shaped disposable eco-friendly housing structure; said selectively openable and closable lid member is movably connected to said main theme-shaped disposable eco-friendly housing structure so that said lid member is constrained to move in a flat plane which is disposed substantially parallel to said base; and a predetermined area for the placement thereon of a logo or emblem.

It is a primary object of the present invention to provide a specific theme-shaped eco-friendly disposable wet wipe container.

Another object of the present invention is to provide a novel and unique specific theme-shaped eco-friendly disposable wet wipe container fabricated from a renewable resource, and methods of constructing and utilizing same.

A further object of the present invention to provide a container as described above which includes a swivel pin device movably interconnecting said main theme-shaped disposable eco-friendly housing structure and said selectively openable and closable lid member to enable said lid member to swivel in said flat plane which is disposed substantially parallel to said base.

Yet another object of the present invention to provide a specific theme-shaped eco-friendly disposable wet wipe container having a slide track mechanism movably interconnecting said main theme-shaped disposable eco-friendly housing structure and said selectively openable and closable lid member to enable said lid member to linearly translate or swivel in said flat plane which is disposed substantially parallel to said base.

Yet another object of the present invention to provide a specific theme-shaped eco-friendly disposable wet wipe container wherein said main theme-shaped disposable eco-friendly housing structure includes a compartment for wet wipes and an empty compartment.

A further object of the present invention to provide a specific theme-shaped eco-friendly disposable wet wipe container wherein said main theme-shaped disposable eco-friendly housing structure includes a compartment for wet wipes and an empty compartment, and a removable film covering said compartment for wet wipes.

Other objects, advantages, and features of the present invention will become apparent to those persons skilled in this particular area of technology and to other persons after having been exposed to the present patent application when read in conjunction with the accompanying patent drawings.

DETAILED DESCRIPTION OF THE INVENTION

Figure 1:
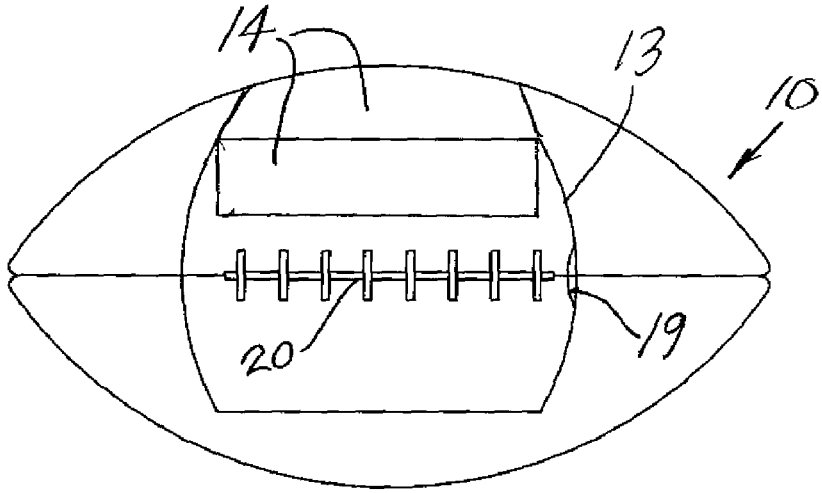
FIG. 1 is a top plan view of a first embodiment of the present invention.
Figure 2:
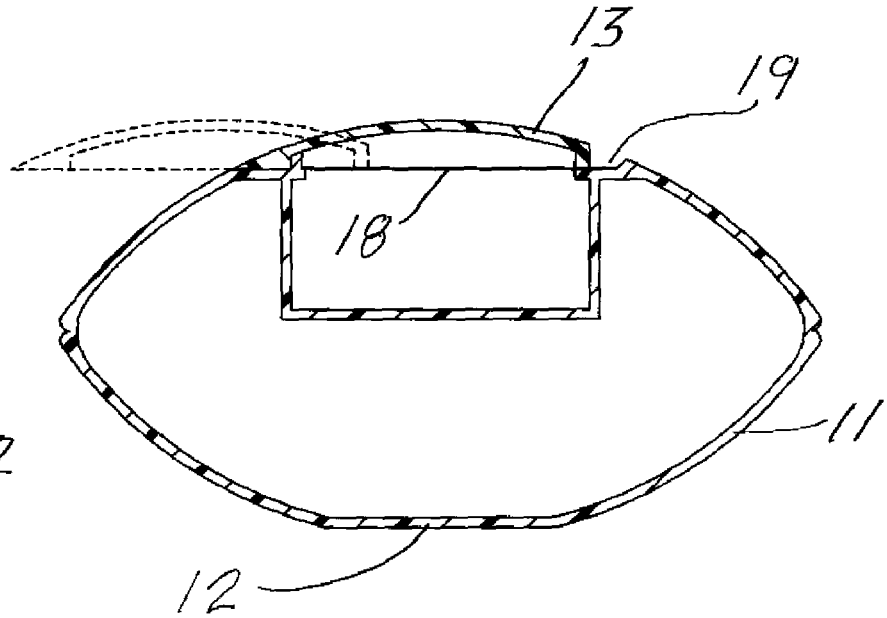
FIG. 2 is a cross-sectional view of the apparatus depicted in FIG. 1 showing in phantom the lid member slid to an almost completely open position.
Figure 3:
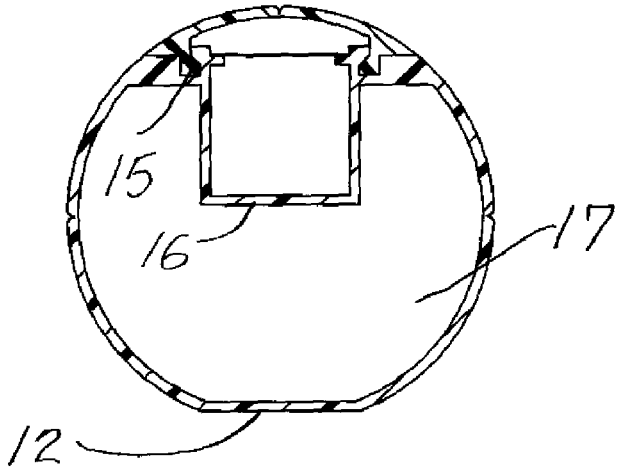
FIG. 3 shows a tranverse cross-sectional view of FIG. 1.

With reference to FIGS. 1-3, there is shown a specific theme-shaped eco-friendly disposable wet wipe container 10 in accordance with a first embodiment of the invention.

The container 10 include a main theme-shaped disposable eco-friendly housing structure 11 for holding therein a plurality of wet wipes (not shown).

The main theme-shaped disposable eco-friendly housing structure 11 is provided with a base 12.

There is provided a selectively openable and closable lid member 13 for said main theme-shaped disposable eco-friendly housing structure 11.

The selectively openable and closable lid member 13 is movably connected to said main theme-shaped disposable eco-friendly housing structure 11 so that said lid member 13 is constrained to move in a flat plane which is disposed substantially parallel to said base 12.

There is also provided one or more predetermined areas 14 for the placement thereon of a personalizable logo or emblem (not shown). For example, for the football shaped container 10, the user may use the logo or emblem of the favorite football team of the user.

On the football embodiment of the invention, the lid member 13 may be provided with design football laces 20.

The container 10 includes a slide track mechanism 15 movably interconnecting said main theme-shaped disposable eco-friendly housing structure 11 and said selectively openable and closable lid member 13 to enable said lid member 13 to linearly translate or slide in said flat plane which is disposed substantially parallel to said base 12.

There is also provided a recessed area 19 to accommodate a finger of the user for pushing or pulling the lid member 13 to slide in the track mechanism 15.

The main theme-shaped disposable eco-friendly housing structure 11 includes a compartment 16 for wet wipes and an empty compartment 17.

There is also provided a removable and/or resealable film 18 covering the compartment 16 for wet wipes.

Fabrication may be of standard commercially-available materials.

Alternatively, the entire container 10 or the major portion thereof may be fabricated from a renewable resource.

More particularly, the container 10 may be fabricated from a renewable resource, for example, such as bamboo pulp, corn sugar or a fibrous residue remaining after sugarcane or sorghum stalks are crushed to extract their juice.

Figure 4:
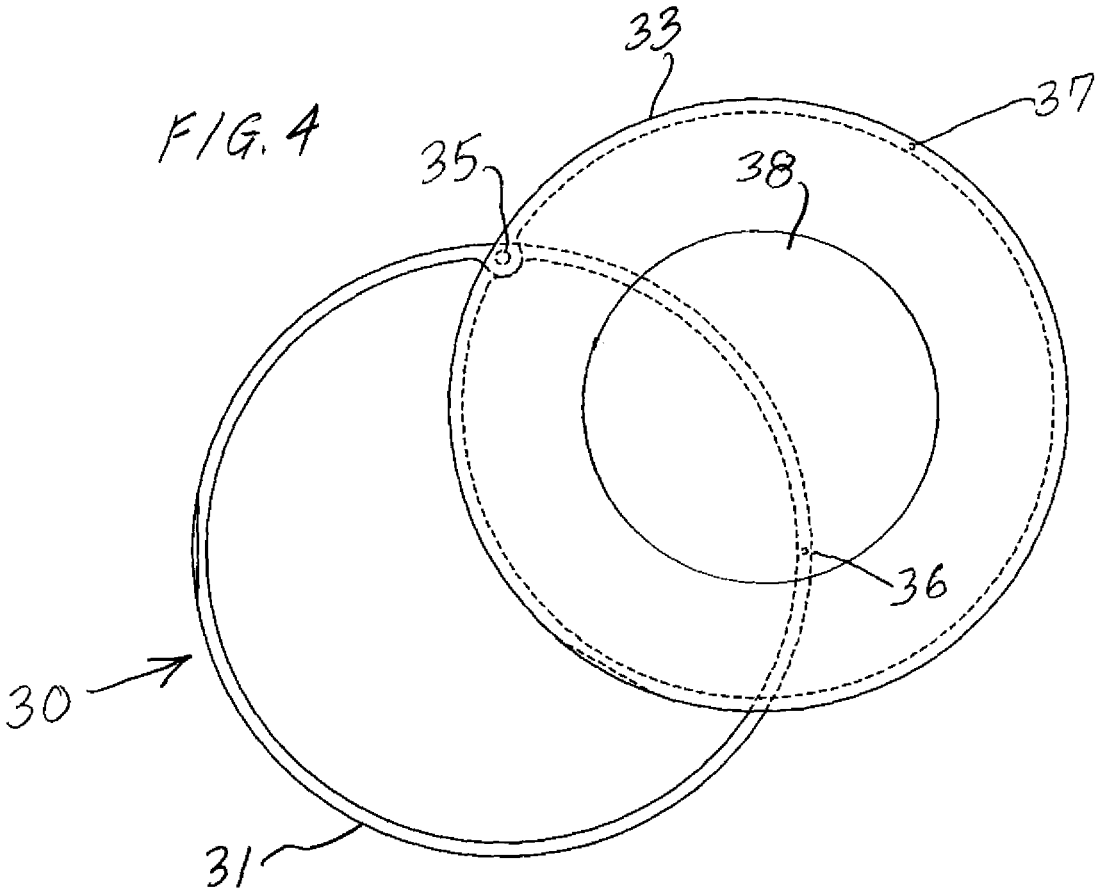
FIG. 4 is a top plan view of a second embodiment of the present invention the apparatus in an almost completely open position.
Figure 5:
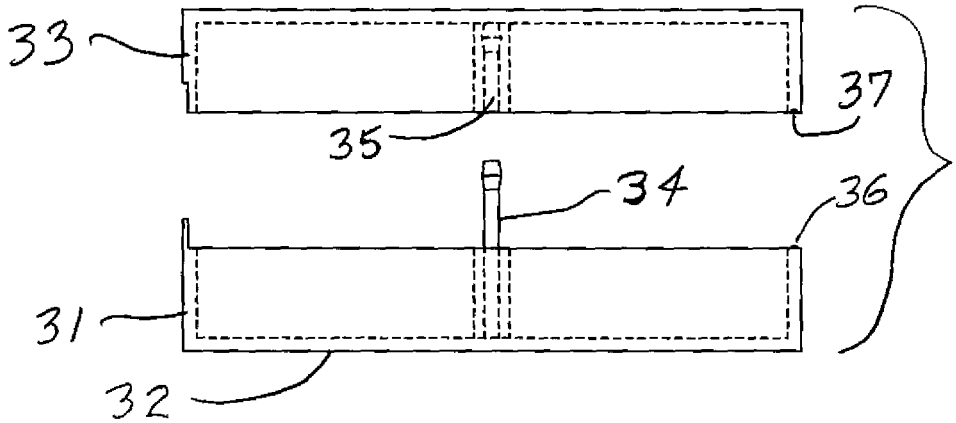
FIG. 5 is view of the FIG. 4 components showing how they are assembled together.

With reference to FIGS. 4 and 5, there is shown a specific theme-shaped eco-friendly disposable wet wipe container 30 in accordance with a second embodiment of the invention.

The container 30 include a main theme-shaped disposable eco-friendly housing structure 31 for holding therein a plurality of wet wipes (not shown).

The main theme-shaped disposable eco-friendly housing structure 31 is provided with a base 32.

There is provided a selectively openable and closable lid member 33 for said main theme-shaped disposable eco-friendly housing structure 31.

The selectively openable and closable lid member 33 is movably connected to said main theme-shaped disposable eco-friendly housing structure 31 so that said lid member 33 is constrained to move in a flat plane which is disposed substantially parallel to said base 32.

There is provided a swivel pin device, comprising a swivel pin 34 and a mating swivel pin recess 35, movably interconnecting said main theme-shaped disposable eco-friendly housing structure 31 and said selectively openable and closable lid member 33 to enable said lid member 33 to swivel in said flat plane which is disposed substantially parallel to said base 32.

A protrusion 36 and a mating dimple 37 serve to keep the lid member 33 from inadvertently swivelling open when not so desired.

There is also provided a predetermined area 38 for the placement thereon of a personalizable logo or emblem (not shown). For example, for the hockey puck shaped container 30, the user may use the logo or emblem of the favorite hockey team of the user.

Fabrication may be of standard commercially-available materials.

Alternatively, the entire container 30 or the major portion thereof may be fabricated from a renewable resource.

More particularly, the container 30 may be fabricated from a renewable resource, for example, such as bamboo pulp, corn sugar or a fibrous residue remaining after sugarcane or sorghum stalks are crushed to extract their juice.

There have been illustrated in the accompanying drawings and described hereinabove only two possible unique and novel embodiments of the present invention which can be practiced and constructed in many different embodiments, configurations, materials, arrangements of components, sizes, and shapes.

It should be understood that many changes, modifications, variations, and other uses and applications will become apparent to those persons skilled in this particular area of technology and to others after having been exposed to the present patent specification and accompanying drawings.

Any and all such changes, modifications, variations and other uses and applications which do not depart from the spirit and scope of the present invention are therefore covered by and embraced within the present invention and the patent claims set forth hereinbelow.

The invention claimed is:

1. A specific theme-shaped eco-friendly disposable wet wipe container, comprising:

a main theme-shaped disposable eco-friendly housing for holding therein a plurality of wet wipes;

the eco-friendly disposable wet wipe container has a shape of a football;

said main theme-shaped disposable eco-friendly housing has a prolate spheroidal structure which is provided with a first flat planar base member;

a selectively openable and closable lid member for said main theme-shaped disposable eco-friendly housing;

said selectively openable and closable lid member forms a first portion of said prolate spheroidal structure and is provided with design football laces thereon;

said selectively openable and closable lid member is movably connected to said main theme-shaped disposable eco-friendly housing structure so that said lid member is constrained to linearly translate in a flat plane which is disposed substantially parallel to said first flat planar base member;

a slide track mechanism movably interconnecting said main theme-shaped disposable eco-friendly housing and said selectively openable and closable lid member to enable said lid member to linearly translate in said flat plane which is disposed parallel to said first flat planar base member;

said prolate spheroidal structure is provided with a recessed area;

said recessed area is provided adjacent one end of said selectively openable and closable lid member;

said recessed area is designed and dimensioned to accommodate a finger of an user of the eco-friendly disposable wet wipe container for pushing said selectively openable and closable lid member to slide in said slide track mechanism;

said main theme-shaped disposable eco-friendly housing and said selectively openable and closable lid member are fabricated from a renewable resource, selected from the group consisting of bamboo pulp, corn sugar or a fibrous residue remaining after sugarcane or sorghum stalks are crushed to extract their juice;

said main theme-shaped disposable eco-friendly housing includes two and only two compartments;

said two compartments comprise an uppermost compartment for wet wipes which is contiguous with and depends directly into a lowermost empty compartment;

a removable and resealable film covers said uppermost compartment for wet wipes;

said uppermost compartment for wet wipes has the shape of a rectangular parallelepiped which is separated from said selectively openable and closable lid member by said removable and resealable film;

said uppermost compartment for wet wipes is provided with a second flat planar base member;

said second flat planar base member of said uppermost compartment for wet wipes is disposed parallel to said first flat planar base member of said prolate spheroidal structure; and an area on said prolate spheroidal structure for the placement thereon of a logo or emblem.

2. A football-shaped eco-friendly disposable wet wipe container, comprising:

a football-shaped disposable eco-friendly housing for holding therein a plurality of wet wipes;

said football-shaped disposable eco-friendly housing has a prolate spheroidal structure which is provided with a first flat planar base member;

a selectively openable and closable lid member for said football-shaped disposable eco-friendly housing;

said selectively openable and closable lid member forms a first portion of said prolate spheroidal structure and is provided with design football laces thereon;

said selectively openable and closable lid member is movably connected to said football-shaped disposable eco-friendly housing so that said lid member is constrained to linearly translate in a flat plane which is disposed parallel to said first flat planar base member;

a slide track mechanism movably interconnects said football-shaped disposable eco-friendly housing and said selectively openable and closable lid member to enable said lid member to linearly translate in said flat plane which is disposed parallel to said first flat planar base member;

said prolate spheroidal structure is provided with a recessed area;

said recessed area is provided adjacent one end of said selectively openable and closable lid member;

said recessed area is designed and dimensioned to accommodate a finger of an user of the football-shaped eco-friendly disposable wet wipe container for pushing said selectively openable and closable lid member to slide in said slide track mechanism;

said football-shaped disposable eco-friendly housing and said selectively openable and closable lid member are fabricated from a renewable resource, selected from the group consisting of bamboo pulp, corn sugar or a fibrous residue remaining after sugarcane or sorghum stalks are crushed to extract their juice;

said football-shaped disposable eco-friendly housing includes two and only two compartments;

said two compartments comprise an uppermost compartment for wet wipes which is contiguous with and depends directly into a lowermost empty compartment;

said first flat planar base member and a second portion of said prolate spheroidal structure form outer walls of said lowermost empty compartment;

a removable and resealable film covers said uppermost compartment for wet wipes;

said uppermost compartment for wet wipes has the shape of a rectangular parallelepiped which is separated from said selectively openable and closable lid member by said removable and resealable film;

said uppermost compartment for wet wipes is provided with a second flat planar base member;

said second flat planar base member of said uppermost compartment for wet wipes is disposed parallel to said first flat planar base member of said prolate spheroidal structure; and a plurality of areas on said prolate spheroidal structure for the placement thereon of a logos or emblems.

3. A specific theme-shaped eco-friendly disposable wet wipe container, comprising:

a main theme-shaped disposable eco-friendly housing structure for holding therein a plurality of wet wipes;

said main theme-shaped disposable eco-friendly housing structure is provided with a base;

a selectively openable and closable lid member for said main theme-shaped disposable eco-friendly housing structure;

said selectively openable and closable lid member is movably connected to said main theme-shaped disposable eco-friendly housing structure so that said lid member is constrained to linearly translate in a flat plane which is disposed substantially parallel to said base;

a slide track mechanism movably interconnecting said main theme-shaped disposable eco-friendly housing structure and said selectively openable and closable lid member to enable said lid member to linearly translate in said flat plane which is disposed substantially parallel to said base;

said main theme-shaped disposable eco-friendly housing structure and said selectively openable and closable lid member are fabricated from any renewable resource, selected from the group consisting of bamboo pulp, corn sugar or a fibrous residue remaining after sugarcane or sorghum stalks are crushed to extract their juice;

said main theme-shaped disposable eco-friendly housing structure includes two and only two compartments;

said two compartments comprise an uppermost compartment for wet wipes which is contiguous with and depends directly into a lowermost empty compartment;

a removable film covering said uppermost compartment for wet wipes;

an area for the placement thereon of a logo or emblem;

said container is in the shape of a football;

said uppermost compartment for wet wipes has the shape of a rectangular parallelepiped which is separated from said selectively openable and closable lid member by said removable and resealable film;

said selectively openable and closable lid member forms a first portion of a prolate spheroidal structure and is provided with design football laces thereon;

said selectively openable and closable lid member forms a first portion of a prolate spheroidal structure and is provided with design football laces thereon;

the container has an elongated central axis;

the container has a central medial cross-section transverse to said elongated central axis, in which said central medial cross-section said base, said removable film, said flat plane, and a base of said uppermost compartment for wet wipes are parallel to each other, and in which said central medial cross-section said main theme-shaped disposable eco-friendly housing structure appears circular except for said base of said main theme-shaped disposable eco-friendly housing structure;

said prolate spheroidal structure is provided with a recessed area;

said recessed area is provided adjacent one end of said selectively openable and closable lid member and adjacent a top portion of said rectangular parallelepiped; and said recessed area is designed and dimensioned to accommodate a finger of an user of the football-shaped eco-friendly disposable wet wipe container for pushing said selectively openable and closable lid member to slide in said slide track mechanism.

4. The container of claim 1, wherein:

the container has an elongated central axis; and the container has a central medial cross-section transverse to said elongated central axis, in which said central medial cross-section said first flat planar base member, said removable film, said flat plane, and said second flat planar base member are parallel to each other, and in which said central medial cross-section said main theme-shaped disposable eco-friendly housing structure appears circular except for said first flat planar base member of said main theme-shaped disposable eco-friendly housing structure.

5. The container of claim 2, wherein:

the container has an elongated central axis; and the container has a central medial cross-section transverse to said elongated central axis, in which said central medial cross-section said first flat planar base member, said removable film, said flat plane, and said second flat planar base member are parallel to each other, and in which said central medial cross-section said main theme-shaped disposable eco-friendly housing structure appears circular except for said first flat planar base member of said main theme-shaped disposable eco-friendly housing structure.

6. The container of claim 1, including:

fixed structures interconnecting said prolate spheroidal structure to sides walls of said rectangular parallelepiped;

said fixed structures are disposed parallel to said first flat planar base member, said removable film, said flat plane, and said second flat planar base member; and said fixed structures include a main portion of said slide track mechanism.

7. The container of claim 2, including:

fixed structures interconnecting said prolate spheroidal structure to sides walls of said rectangular parallelepiped;

said fixed structures are disposed parallel to said first flat planar base member, said removable film, said flat plane, and said second flat planar base member; and said fixed structures include a main portion of said slide track mechanism.

8. The container of claim 3, including:

fixed structures interconnecting said prolate spheroidal structure to sides walls of said rectangular parallelepiped;

said fixed structures are disposed parallel to said base of said main theme-shaped disposable eco-friendly housing structure, said removable film, and said flat plane; and said fixed structures include a main portion of said slide track mechanism.

9. The container of claim 4, including:

fixed structures interconnecting said prolate spheroidal structure to sides walls of said rectangular parallelepiped;

said fixed structures are disposed parallel to said first flat planar base member, said removable film, said flat plane, and said second flat planar base member; and said fixed structures include a main portion of said slide track mechanism.

10. The container of claim 5, including:

fixed structures interconnecting said prolate spheroidal structure to sides walls of said rectangular parallelepiped;

said fixed structures are disposed parallel to said first flat planar base member, said removable film, said flat plane, and said second flat planar base member; and said fixed structures include a main portion of said slide track mechanism.

11. The container of claim 1, wherein:

said lowermost empty compartment is formed by said first flat planar base member of said main theme-shaped disposable eco-friendly housing structure, lower portions of said prolate spheroidal structure, and five walls of said rectangular parallelepiped.

12. The container of claim 3, wherein:

said lowermost empty compartment is formed by said base member of said main theme-shaped disposable eco-friendly housing structure, lower portions of said prolate spheroidal structure, and five walls of said rectangular parallelepiped.

13. The container of claim 4, wherein:

said lowermost empty compartment is formed by said first flat planar base member, lower portions of said prolate spheroidal structure, and five walls of said rectangular parallelepiped.

14. The container of claim 5, wherein:

said lowermost empty compartment is formed by said first flat planar base member base of said main theme-shaped disposable eco-friendly housing structure, lower portions of said prolate spheroidal structure, and five walls of said rectangular parallelepiped.

15. The container of claim 6, wherein:

said lowermost empty compartment is formed by said first flat planar base member of said main theme-shaped disposable eco-friendly housing structure, lower portions of said prolate spheroidal structure, said fixed structures, and five walls of said rectangular parallelepiped.

16. The container of claim 7, wherein:

said lowermost empty compartment is formed by said first flat planar base member of said main theme-shaped disposable eco-friendly housing structure, lower portions of said prolate spheroidal structure, said fixed structures, and five walls of said rectangular parallelepiped.

17. The container of claim 8, wherein:

said lowermost empty compartment is formed by said base of said main theme-shaped disposable eco-friendly housing structure, lower portions of said prolate spheroidal structure, said fixed structures, and five walls of said rectangular parallelepiped.

18. The container of claim 9, wherein:

said lowermost empty compartment is formed by said first flat planar base member of said main theme-shaped disposable eco-friendly housing structure, lower portions of said prolate spheroidal structure, said fixed structures, and five walls of said rectangular parallelepiped.

19. The container of claim 10, wherein:

said lowermost empty compartment is formed by said first flat planar base member of said main theme-shaped disposable eco-friendly housing structure, lower portions of said prolate spheroidal structure, said fixed structures, and five walls of said rectangular parallelepiped.

20. The container of claim 19, wherein:

when said selectively openable and closable lid member is in its closed position, there is formed an empty chamber above said rectangular parallelepiped; and said empty chamber is formed between said lid member and said removable and resealable film.

* * * * *